US006676242B2

(12) United States Patent
Yun

(10) Patent No.: US 6,676,242 B2
(45) Date of Patent: Jan. 13, 2004

(54) PRINT HEAD CLEANING APPARATUS AND INK JET PRINTER HAVING THE SAME

(75) Inventor: Seuk-jin Yun, Anyang (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/158,015

(22) Filed: May 31, 2002

(65) Prior Publication Data

US 2003/0071871 A1 Apr. 17, 2003

(30) Foreign Application Priority Data

Oct. 12, 2001 (KR) ..... 2001-63043

(51) Int. Cl.[7] ..... B41J 2/165
(52) U.S. Cl. ..... 347/28
(58) Field of Search ..... 347/28, 22, 20; 15/300.1, 302, 1.51, 3.5, 320, 362, 379, 381, 363, 369

(56) References Cited

U.S. PATENT DOCUMENTS 5,196,136 A * 3/1993 Dishart et al.

* cited by examiner

*Primary Examiner*—Raquel Yvette Gordon
(74) *Attorney, Agent, or Firm*—Staas & Halsey LLP

(57) ABSTRACT

A print head cleaning apparatus of an ink jet printer and an ink jet printer having the same, disposed to be movable between a printing position to eject ink from an ink injection nozzle to print an image on a paper sheet and a cleaning position to clean the ink injection nozzle. The print head is cleaned at the cleaning position using ultrasonic waves. The print head cleaning apparatus is fixed to the printer. The print head is moved to the print head cleaning apparatus and is then cleaned by the print head cleaning apparatus. Therefore, the print head is moved using an existing carrier transferring unit without a separate driving device to drive the print head, thereby facilitating the cleaning operation.

19 Claims, 4 Drawing Sheets

PRINT HEAD CLEANING APPARATUS AND INK JET PRINTER HAVING THE SAME

CROSS-REFERENCE TO RELATED APPLICATIONS

This application claims the benefit of Korean Application No. 2001-63043, filed Oct. 12, 2001, in the Korean Industrial Property Office, the disclosure of which is incorporated herein by reference.

BACKGROUND OF THE INVENTION

1. Field of the Invention

The present invention relates to a print head cleaning apparatus and an ink jet printer having the same, and more particularly, to a print head cleaning apparatus in which clogging of an ink injection nozzle of a print head is prevented.

2. Description of the Related Art

Generally, an ink jet printer is provided with a carriage reciprocally disposed at a main frame. The carriage has an ink cartridge. A moving means reciprocates the carriage, which is supported by a timing belt and a guide shaft. The ink cartridge has a print head at a lower portion thereof. The print head is apart from a sheet of printing paper, which is transferred by a feeding roller, at a desired head gap so that ink is ejected from the print head to the sheet to print an image. In other words, the print head ejects the ink onto the printing paper sheet at a desired distance. The ejected ink forms the image on the sheet. A control portion of the printer controls an ink ejecting operation of the ink injection nozzle according to input image information.

In the aforementioned construction, after a printing operation is completed, the ink remains in the ink injection nozzle. However, if the printer is not used for a long time, the ink remaining in the ink injection nozzle coagulates. In this case, the ink injection nozzle is partially or entirely clogged with the coagulated ink. Therefore, a problem is that the ink injection nozzle cannot precisely eject a proper amount of the ink when performing the printing operation.

Furthermore, the ink injection nozzle may be clogged with a foreign material such as dust, which also deteriorates print quality. Therefore, there is a need for a device to prevent the ink injection nozzle from being clogged.

SUMMARY OF THE INVENTION

Accordingly, it is an object of the present invention to provide a print head cleaning apparatus and an ink jet printer, in which clogging of an ink injection nozzle can be prevented.

Additional objects and advantages of the invention will be set forth in part in the description which follows and, in part, will be obvious from the description, or may be learned by practice of the invention.

The foregoing and other objects of the present invention are achieved by providing a print head cleaning apparatus of an ink jet printer which is disposed to be movable between a printing position to eject ink from an ink injection nozzle of the printer to print an image on a paper sheet, and a cleaning position to clean the ink injection nozzle using ultrasonic waves, the print head cleaning apparatus including a cleaning liquid storing tank to store a cleaning liquid; a cleaning bath disposed at a lower side of the print head in the cleaning position, including a cleaning liquid inlet/outlet port, and an opened upper surface so that the cleaning liquid supplied from the storing tank is opposite the ink injection nozzle at a desired gap; a supplying portion to supply the cleaning liquid of the storing tank to the cleaning bath; and an ultrasonic device to receive a voltage from a power source and to generate a desired intensity of the ultrasonic waves, the cleaning liquid of the cleaning bath forming a column to contact the ink injection nozzle and to thereby clean the ink injection nozzle, the ultrasonic device being disposed in the cleaning bath.

The foregoing and other objects of the present invention are also achieved by providing an ink jet printer including a main frame; a guide shaft disposed in the main frame; a carriage reciprocated along the guide shaft, and disposed to be movable between a home position and a cleaning position which are respectively formed at first and second sides of a printing position of the carriage in which a printing operation is performed; a print head disposed at the carriage to be moved together with the carriage, and including an ink injection nozzle to eject ink to form an image on a paper sheet, the sheet being disposed at a lower side of the carriage; and a print head cleaning unit to clean the ink injection nozzle using ultrasonic waves when the print head is moved to the cleaning position.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
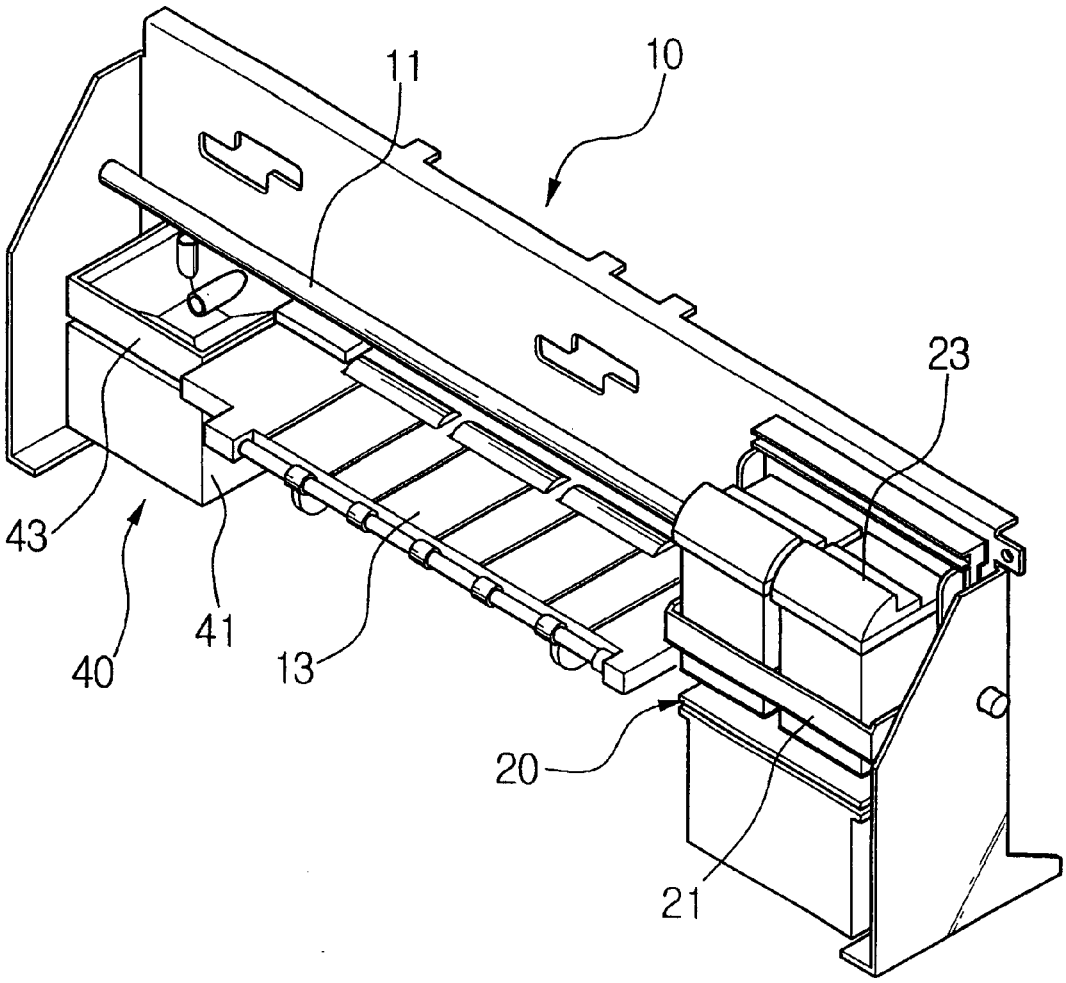
FIG. 1 is a schematic perspective view of an ink jet printer according to an embodiment of the present invention.

Reference will now be made in detail to the present preferred embodiments of the present invention, examples of which are illustrated in the accompanying drawings, wherein like reference numerals refer to like elements throughout.

FIG. 1 is a schematic perspective view of an ink jet printer according to an embodiment of the present invention. Referring to FIG. 1, an ink jet printer includes a main frame 10 provided with a guide shaft 11, a carriage 20 reciprocally disposed on the guide shaft 11, a print head 30 (FIG. 2) provided at a lower portion of the carriage 20, and a cleaning unit 40 to clean an ink injection nozzle of the print head 30.

The main frame 10 forms a body of the printer. The main frame 10 is provided with a base frame 13 disposed at a lower portion of the guide shaft 11. The base frame 13 is provided with a feeding roller (not shown) to transfer a paper sheet upon which the image is printed. A length of the base frame 13 approximately corresponds to a width of the paper sheet. Therefore, the print head 30 ejects ink at a region corresponding to the base frame 13 during reciprocating movement to carry out a printing operation.

Figure 2:
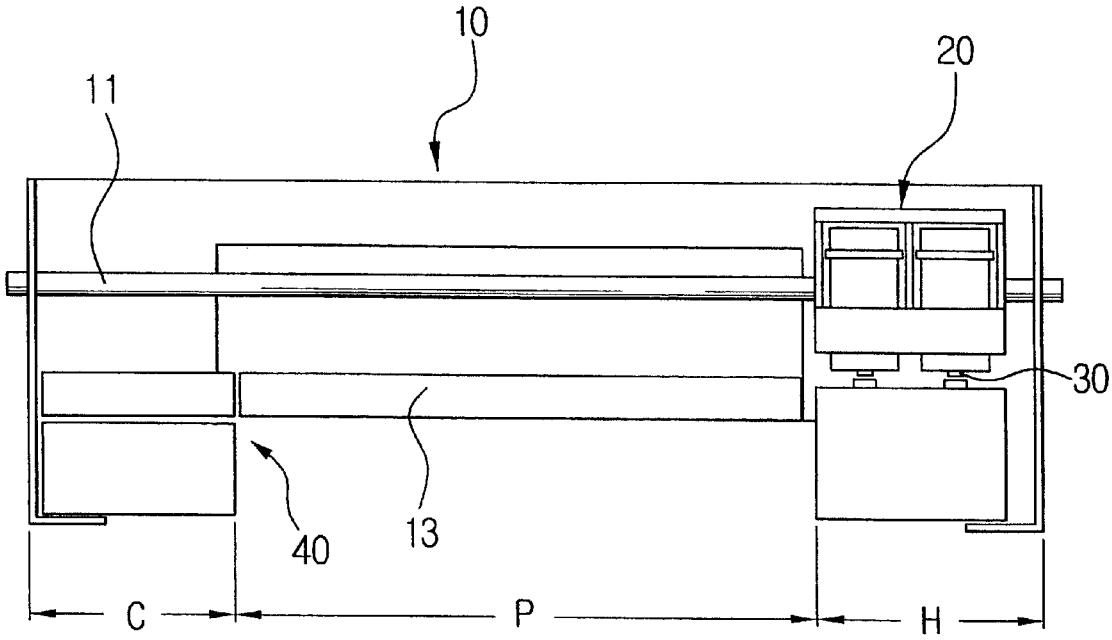
FIG. 2 is a schematic front view of the ink jet printer of FIG. 1.

The carriage 20 is reciprocated on the guide shaft 11 by transferring means (not shown). As shown in FIG. 2, the carriage 20 is moved within a printing portion P to carry out the printing operation, which is placed at a center portion corresponding to the base frame 13, a cleaning position C and a home position H which are respectively placed at a left and right side of the printing position P. The carriage 20 is provided with a carriage body 21 supported by the guide shaft 11, and an ink cartridge 23 removably mounted at the carriage body 21.

Figure 3:
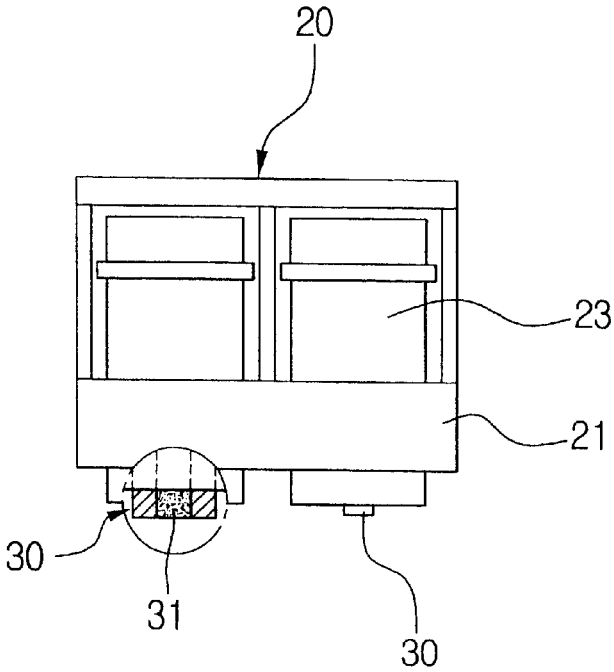
FIG. 3 is a schematic side view of a carriage of FIG. 2.

The print head 30 is disposed at the lower portion of the carriage 20 to eject the ink supplied from the ink cartridge 23 to the paper sheet which is passing an upper portion of the base frame 13, and thus prints the image. Referring to FIG. 3, the print head 30 is provided with an ink injection nozzle 31 at a lower end thereof. The ink injection nozzle 31 is controlled to eject the ink by a control portion (not shown).

Figure 4:
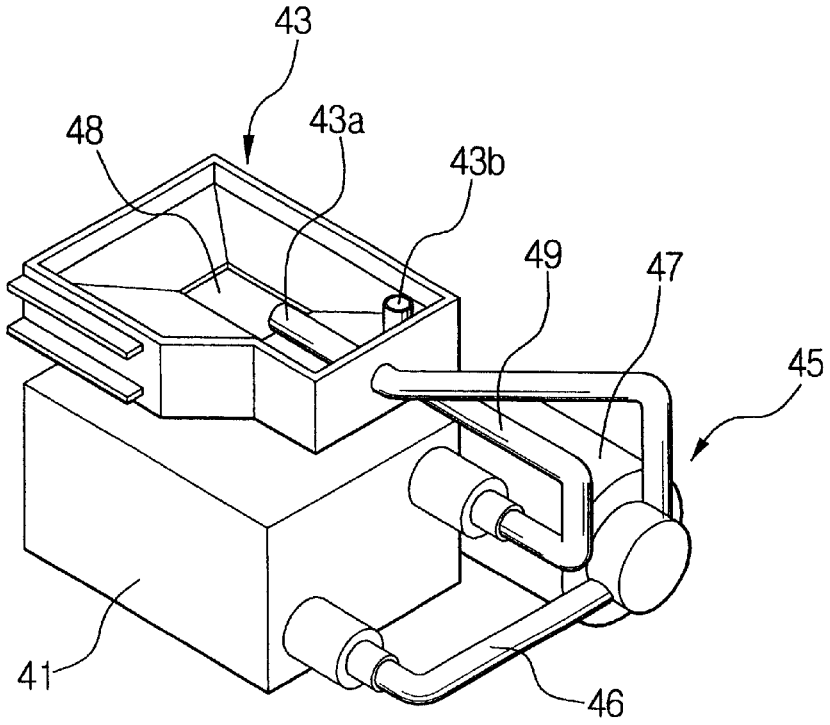
FIG. 4 is a schematic perspective view of a print head cleaning apparatus applied to the ink jet printer of FIG. 1.

The cleaning unit 40 cleans the ink injection nozzle 31 of the print head 30, which is moved to the cleaning position C, using ultrasonic waves. As shown in FIG. 4, the cleaning unit 40 includes a cleaning liquid storing tank 41 to store cleaning liquid, a cleaning bath 43 disposed at an upper side of the storing tank 41, a supplying portion 45 to supply the cleaning liquid of the storing tank 41 to the cleaning bath 43, and an ultrasonic device 48.

The storing tank 41 is disposed at the main frame 10 to correspond to the cleaning position C. The cleaning liquid stored in the storing tank 41 cleans the ink injection nozzle 31, thereby eliminating a foreign substance such as ink residue coagulated in the ink injection nozzle 31 or paper powder. Water or a desired liquid cleaning agent may be used as the cleaning liquid.

The cleaning bath 43 is disposed at the main frame 10 to be placed at a lower side of the print head 30 in the cleaning position C. In addition, the cleaning bath 43 is disposed at the upper side of the storing tank 41. The cleaning bath 43 has an opened upper surface, thereby forming a desired gap between a level of the cleaning liquid supplied by the supplying portion 45 and the print head 30. Furthermore, in the cleaning bath 43, there are formed a cleaning liquid inlet/outlet port 43*a* and a cleaning liquid exhaust port 43*b*. The cleaning liquid inlet/outlet port 43*a* is formed at the bottom of the cleaning bath 43 to introduce the cleaning liquid into the cleaning bath 43 upon driving of the supplying portion 45. However, if an operation of cleaning the print head 30 is finished, the cleaning liquid in the cleaning bath 43 is exhausted through the cleaning liquid inlet/outlet port 43*a* and is then recovered into the storing tank 41. The cleaning liquid exhaust port 43*b* is placed at a higher position than the cleaning liquid inlet/outlet port 43*a*. The cleaning liquid exhaust port 43*b* prevents the level of the cleaning liquid in the storing tank 41 from exceeding a desired height. Therefore, even though an accurate and constant amount of the cleaning liquid is not supplied to the cleaning bath 43, if the level of the cleaning liquid exceeds the desired height, the excess cleaning liquid is exhausted through the cleaning liquid exhaust port 43*b* to be recovered into the storing tank 41. Therefore, the level of the cleaning liquid in the storing tank 41 is constantly maintained at the desired height, and thus the gap between the cleaning liquid and the print head 30 is constant. Moreover, an inside wall of the cleaning bath 43 is inclined toward the cleaning liquid inlet/outlet port 43*a*. The cleaning liquid in the cleaning bath 43 flows down to the cleaning liquid inlet/outlet port 43*a* by its own weight, so that the cleaning liquid is easily discharged.

The supplying portion 45 has a cleaning liquid supplying path 46 to connect the storing tank 41 and the inlet/outlet port 43*a*, and a cleaning liquid supplying pump 47 disposed at the cleaning liquid supplying path 46. The supplying pump 47 is disposed at the main frame 10 to forcibly pump the cleaning liquid stored in the storing tank 41 into the cleaning bath 43. Herein, the cleaning liquid supplying pump 47 supplies the cleaning liquid of the storing tank 41 to the cleaning path 46. The cleaning liquid is returned from the cleaning bath 43 into the storing tank 41 by the weight of the cleaning liquid.

Furthermore, there is a cleaning liquid exhaust path 49 to connect the storing tank 41 and the cleaning liquid exhaust port 43*b*. A flexible hose may be used as the exhaust path 49 and the supplying path 46.

The ultrasonic device 48 is disposed at the bottom of the cleaning bath 43. The ultrasonic device 48 is a high frequency generating device to receive a desired intensity of voltage from a power source and generate a desired intensity of a high frequency. The intensity of the high frequency generated from the ultrasonic device 48 is about 500 KHz to 2 MHz. Furthermore, the ultrasonic device 48 may have various shapes such as a circle or a quadrangle, etc.

Between the cleaning bath 43 and the ultrasonic device 48, there is a sealing member 50 of rubber material to seal therebetween.

Now, an operation of the ink jet printer according to the present invention, as described above, will be described. First, when the printer does not perform the printing operation, as shown in FIG. 2, the print head 30 is placed at the home position H together with the carriage 20. In this position, the print head 30 is in a standby state for the printing operation. The print head 30 may be cleaned by wiping means.

Meanwhile, if the print head 30 is left in the standby state for a long time, the ink remaining in the ink injection nozzle 31 from the previous printing operation may dry and coagulate. Thus, a part of the ink injection nozzle 31 may be clogged with the ink residue or another foreign substance. Therefore, when the printer is not used for a long time, after printing a test pattern on a paper sheet, the user can confirm whether a printing omission has occurred in the printed test pattern.

Figure 5:
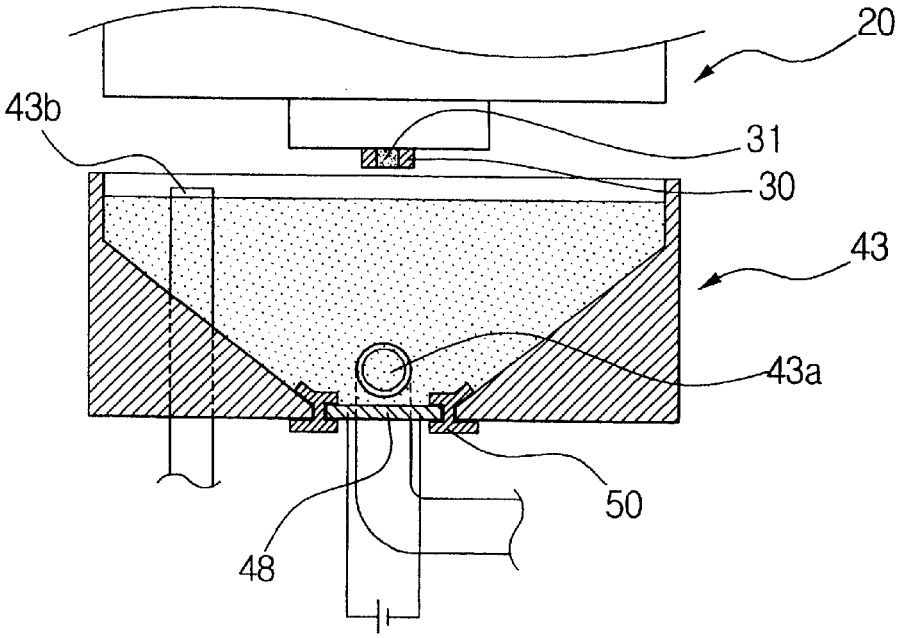
FIGS. 5 to 7 are schematic views showing an operation of cleaning a print head using the print head cleaning apparatus of FIG. 1.
Figure 6:
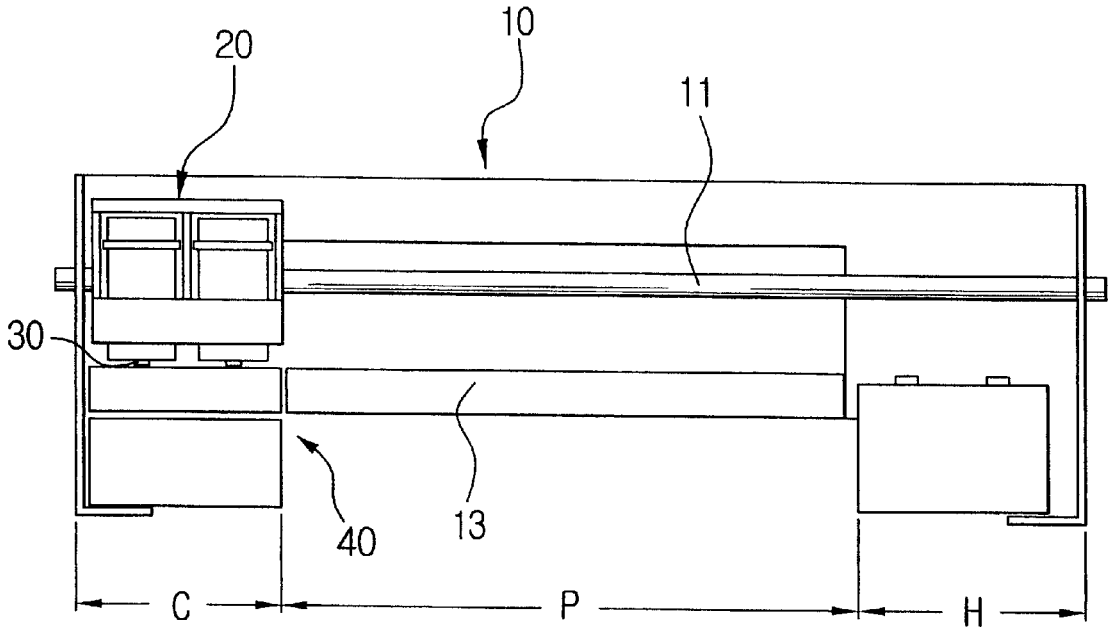

If the printing omission occurs in the printed test pattern, the user performs manual cleaning or operates a function key to perform a cleaning operation. In other words, as shown in FIG. 6, the carriage 20 is moved to the cleaning position C in a cleaning mode. In this situation, the user drives the supplying pump 47 to supply the cleaning liquid from the storing tank 41 to the cleaning bath 43. And, as shown in FIG. 5, the cleaning bath 43 is filled with the cleaning liquid to the same height as the exhaust port 43*b*. The cleaning liquid, which exceeds the height of the exhaust port 43*b*, is recovered through the exhaust port 43*b* into the storing tank 41. At this time, a surface of the cleaning liquid is separate from a surface of the ink injection nozzle 31 at a distance of about 0.5 mm–10 mm. The distance may be determined according to the height of the exhaust port 43*b* and a mounting position of the cleaning bath 43.

Figure 7:
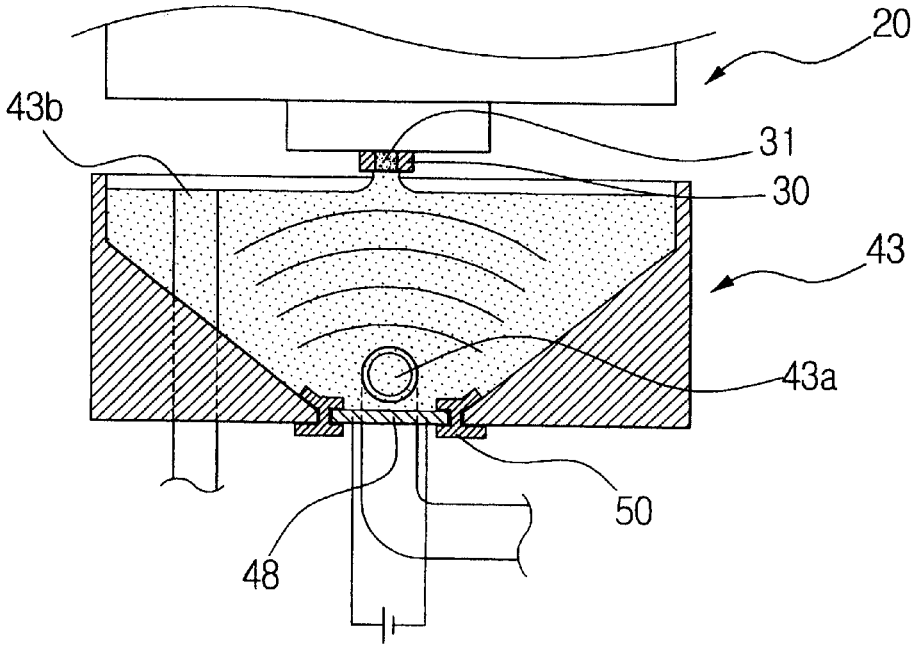

Meanwhile, if the voltage is applied to the ultrasonic device 48, while the cleaning liquid is supplied to the cleaning bath 43, the ultrasonic device 48 generates the desired intensity of the high frequency. In this case, as shown in FIG. 7, there is formed a column of the cleaning liquid between the surface of the cleaning liquid and the ink injection nozzle 31 due to the high frequency energy. Thus, the cleaning liquid having the high frequency energy contacts the ink injection nozzle 31, so that the ink residue or other foreign substance coagulated in the ink injection nozzle 31 is cleaned and eliminated by the cleaning liquid.

After the ink injection nozzle 31 is cleaned using the ultrasonic waves, the user stops the operation of the supplying pump 47. Then, the cleaning liquid in the cleaning bath 43 flows through the inlet/outlet port 43*a* so as to be recovered into the storing tank 41. This flow occurs while the pump 47 fills the cleaning bath 43. At this time, since the inside wall of the cleaning bath 43 is inclined to the inlet/outlet port 43*a*, the cleaning liquid easily flows downward.

Furthermore, the cleaning liquid on the ink injection nozzle 31 of the print head 30 is cleaned at the home position H by the wiping means.

As described above, the clogging of the ink injection nozzle 31 can be easily solved before performing of the printing operation. Thus, image quality is improved.

According to the print head cleaning apparatus and the ink jet printer of the present invention, the print head cleaning apparatus is fixed to the printer. The print head is moved to the print head cleaning apparatus and is then cleaned by the print head cleaning apparatus. Therefore, the print head is moved using an existing carrier transferring unit without a separate driving device to drive the print head, thereby facilitating the cleaning operation.

Furthermore, the clogging of the ink injection nozzle is eliminated using a column of the cleaning liquid, which is formed by a high frequency. Thus, the ink can be easily ejected, when performing the printing operation, so that the printed image quality is improved.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A print head cleaning apparatus of an ink jet printer having a print head, movable between a printing position to eject ink from an ink injection nozzle of the print head to print an image on a paper sheet, and a cleaning position to clean the ink injection nozzle, the print head cleaning apparatus comprising:

a cleaning liquid storing tank to store a cleaning liquid;

a cleaning bath disposed at a lower side of the print head in the cleaning position, comprising:

a cleaning liquid inlet/outlet port, and an opened upper surface so that the cleaning liquid supplied from the storing tank is opposite the ink injection nozzle at a desired gap;

a supplying portion to supply the cleaning liquid of the storing tank to the cleaning bath; and an ultrasonic device to receive a voltage from a power source and to generate a desired intensity of ultrasonic waves, the cleaning liquid of the cleaning bath forming a column to contact the ink injection nozzle and thereby clean the ink injection nozzle, the ultrasonic device being disposed in the cleaning bath.

2. The apparatus of claim 1, wherein the supplying portion comprises:

a cleaning liquid supplying path to connect the storing tank and the cleaning liquid inlet/outlet port; and a cleaning liquid supplying pump to provide a pumping force to the cleaning liquid in the storing tank, disposed at the cleaning liquid supplying path.

3. The apparatus of claim 1, wherein the cleaning liquid inlet/outlet port is disposed at a bottom portion of the cleaning bath, and the cleaning bath comprises an inside wall which is inclined to the cleaning liquid inlet/outlet port, so that the cleaning liquid flows from the cleaning bath to the cleaning liquid inlet/outlet port.

4. The apparatus of claim 1, further comprising:

a cleaning liquid exhaust port, formed in the cleaning bath at a desired height; and a cleaning liquid exhaust path to connect the storing tank and the cleaning liquid exhaust port, the cleaning liquid exhaust port maintaining a constant distance between the ink injection nozzle and a level of the cleaning liquid supplied to the cleaning bath.

5. The apparatus of claim 1, further comprising a sealing member between the ultrasonic device and the cleaning bath, wherein the ultrasonic device is disposed at a bottom portion of the cleaning bath.

6. An ink jet printer, comprising:

a main frame;

a guide shaft disposed in the main frame;

a carriage reciprocated along the guide shaft, and movable between a home position and a cleaning position which are respectively formed at first and second sides of a printing position of the carriage in which a printing operation is performed;

a print head disposed at the carriage to be moved together with the carriage, and comprising an ink injection nozzle to eject ink to form an image on a paper sheet, the sheet being disposed at a lower side of the carriage; and a print head cleaning unit to clean the ink injection nozzle using ultrasonic waves when the print head is moved to the cleaning position.

7. The printer of claim 6, wherein the print head cleaning unit comprises:

a cleaning liquid storing tank to store a cleaning liquid, the storing tank being disposed at the main frame below the print head when the print head is at the cleaning position;

a cleaning bath fixed to the main frame between the storing tank and the print head when the print head is at the cleaning position, the cleaning bath receiving the cleaning liquid from the storing tank, the cleaning bath comprising an opened upper surface so that the cleaning liquid received from the storing tank is opposite the ink injection nozzle at a desired gap;

a supplying portion disposed at the main frame to supply the cleaning liquid in the storing tank to the cleaning bath; and an ultrasonic device to receive a voltage from a power source and generate a desired intensity of the ultrasonic waves, so that the cleaning liquid in the cleaning bath forms a column to contact the ink injection nozzle and thereby clean the ink injection nozzle, the ultrasonic device being disposed in the cleaning bath.

8. The printer of claim 7, wherein the supplying portion comprises:

a cleaning liquid supplying path to connect the storing tank and the cleaning bath; and a cleaning liquid supplying pump disposed at the cleaning liquid supplying path to provide a pumping force to the cleaning liquid in the storing tank.

9. The printer of claim 7, wherein the cleaning bath comprises:

a cleaning liquid inlet/outlet port disposed at a bottom portion of the cleaning bath, and an inside wall inclined to the cleaning liquid inlet/outlet port, so that the cleaning liquid flows down to the cleaning liquid inlet/outlet port.

10. A print head cleaning apparatus of an ink jet printer having a print head having an ink ejection nozzle, the print head cleaning apparatus comprising:

a cleaning bath to contain a cleaning liquid, the cleaning bath forming an open portion opposite the ink ejection nozzle; and an ultrasonic unit to generate ultrasonic waves, the cleaning liquid in the cleaning bath forming a column in response to the ultrasonic waves to contact the ink injection nozzle and thereby clean the ink injection nozzle.

11. The apparatus of claim 10, wherein the print head moves between a printing position to eject ink from the ink injection nozzle and thereby print an image on a paper, and a cleaning position to clean the ink injection nozzle using the ultrasonic waves.

12. The apparatus of claim 11, further comprising:

a cleaning liquid storing tank to store the cleaning liquid; and a pump to pump the cleaning liquid from the storing tank to the cleaning bath.

13. The apparatus of claim 12, further comprising a cleaning liquid exhaust port to maintain a constant level of the cleaning liquid in the cleaning bath.

14. An ink jet printer, comprising:

a guide shaft;

a carriage reciprocated along the guide shaft;

a print head disposed on the carriage, comprising an ink injection nozzle; and a print head cleaning apparatus, comprising:

a cleaning bath to contain a cleaning liquid, the cleaning bath forming an open portion opposite the ink ejection nozzle, and an ultrasonic unit to generate ultrasonic waves, the cleaning liquid in the cleaning bath forming a column in response to the ultrasonic waves to contact the ink injection nozzle and thereby clean the ink injection nozzle.

15. The apparatus of claim 14, wherein the print head moves between a printing position to eject ink from the ink injection nozzle and print an image on a paper, and a cleaning position to clean the ink injection nozzle using the ultrasonic waves.

16. The apparatus of claim 15, wherein the cleaning position is at an end of the guide shaft.

17. The apparatus of claim 15, further comprising a transferring unit to move the print head between the printing position and the cleaning position.

18. A method of cleaning an ink jet printer having an ink ejection nozzle, the method comprising:

providing a cleaning liquid opposite the ink ejection nozzle; and generating ultrasonic waves in the cleaning liquid, the cleaning liquid forming a column in response to the ultrasonic waves to contact the ink injection nozzle and thereby clean the ink injection nozzle.

19. The method of claim 18, further comprising:

moving the ink ejection nozzle between a printing position to eject ink from the ink injection nozzle and thereby print an image on a paper, and a cleaning position to clean the ink injection nozzle using the ultrasonic waves.

* * * * *